United States Patent [19]

Horstmann

[11] 3,991,735

[45] Nov. 16, 1976

[54] INTERNAL COMBUSTION ENGINE

[75] Inventor: Bernhard Horstmann, Glehn-Espendorf, Germany

[73] Assignee: International Harvester Company, Chicago, Ill.

[22] Filed: Nov. 19, 1975

[21] Appl. No.: 633,335

[30] Foreign Application Priority Data

Nov. 26, 1974 Germany ..... 2455865

[52] U.S. Cl. ..... 123/195 C; 123/52 MC; 123/195 R; 123/198 C; 181/33 G

[51] Int. Cl.[2] ..... F02B 75/18

[58] Field of Search ..... 123/52 MC, 195 R, 195 C, 123/198 C, 198 E, 41.33, 41.42, 41.62; 181/33.4

[56] References Cited

UNITED STATES PATENTS

| | | | |
|---|---|---|---|
| 2,981,247 | 4/1961 | Gaebler | 123/195 C |
| 3,464,398 | 9/1969 | Scheiterlein | 123/195 R |
| 3,540,425 | 11/1970 | Scheiterlein | 123/195 R |
| 3,601,101 | 8/1971 | Thien | 123/41.62 |

*Primary Examiner*—Charles J. Myhre
*Assistant Examiner*—Daniel J. O'Connor
*Attorney, Agent, or Firm*—Raymond C. Parks; Floyd B. Harman

[57] ABSTRACT

An internal combustion engine, which has sound-proofing cowling, uses the space between the sidewalls of the cylinder block and the cowling to provide a reservoir for a liquid lubricant media. A cover cap is provided over the fuel injection and valve timing mechanisms, and the space between the cover cap and the cowling, which is over the top of the cylinder head, provides a chamber for receiving coolant from the engine cooling system. The large surface area of the cowling along the sides of the cylinder block accommodates the transfer of heat from the lubricant to the atmosphere. In addition both the lubricant and the coolant serve as sound deadening medias in the sidewall reservoirs and in the overhead chamber.

27 Claims, 1 Drawing Figure

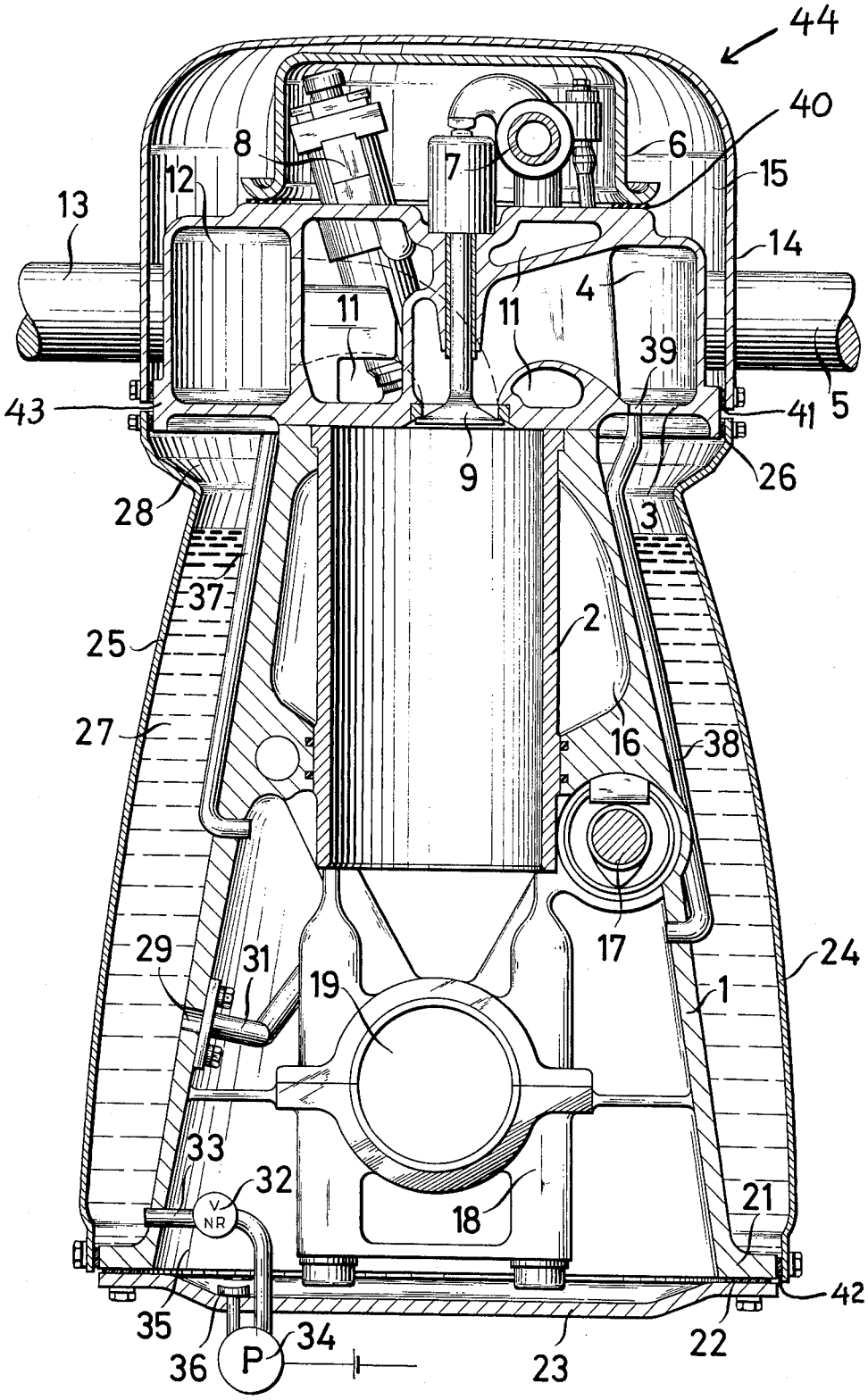
44
40
8
6
7
15
12
13
14
4
11
11
39
43
41
5
9
26
28
3
37
2
25
27
16
38
17
29
31
24
19
1
33
32
V
NR
21
18
42
35
34
22
36
P
23

INTERNAL COMBUSTION ENGINE

BACKGROUND OF THE INVENTION

This invention relates to an internal combustion engine whih has lubricating and liquid cooling systems and is provided with soundproofing cowling. More particularly it relates to the utilization of the lubricant and coolant as Soundproofing medias in the spaces between the engine and the cowling.

1. Field of the Invention

The addition of a soundproofing cowling to an internal combustion engine invariably produces higher wall temperatures and a corresponding increase in lubricant temperature. This is due to the inadequate exchange of heat between the outer surface of the engine and the environment. Provision must be made for the dissipation of this excess heat by some means such as an additional cooling system. It is the object of this invention to provide an internal combustion engine which has lubricating and liquid cooling systems with both adequate soundproofing and substantially improved cooling conditions.

2. Description of the Prior Art

The U.S. Pat. No. 3,601,101—Thien et al— Aug. 24, 1971 and U.S. Pat. No. 3,693,602—Thien et al— Sept. 26, 1972, each show an air cooled internal combustion engine which has a lower cowling enclosing the sump, and an intermediate cowling enclosing the crankcase, and an upper cowling enclosing the overhead value timing and fuel injection mechanisms. A cover is also provided for the value timing and fuel injection mechanisms. Cooling air is circulated through the spaces between the cowlings and the outerwalls of the sump, engine and cover.

Two types of liquid cooled internal combustion engines with soundproofing cowling means are shown in the U.S. Pat. No. 3,464,398—Scheiterlein et al— Sept. 2, 1969 and U.S. Pat. No. 3,540,425—Scheiterlein et al— Nov. 17, 1970 (Correspond to German Accepted Printed Applications (DAS) 1 751 124 and 1 775 468). The object of these internal combustion engines was exclusively directed to reducing the noise emanating from the internal combustion engine by suitably designing and shaping the cowling elements for enclosing the internal combustion engine. In both patents either an oil sump was fitted to the bottom end of the crankcase provided with openings, or an oil reservoir was fitted which projected considerably beyond the bottom end of the crankcase. This mode of accommodating the oil (required for lubricating the parts of the internal combustion engine) in a reservoir arranged underneath the crankcase presented the considerable disadvantage of restricting substantially the ground clearance of any vehicle equipped with an internal combustion engine of such design. On certain types of vehicles, for example earth-moving equipment, this is a factor causing considerable inconvenience, since such earthmoving equipment is frequently operated on uneven ground and thus often gets into an inclined position during its operation, so that the oil sump can easily be damaged. Furthermore, in this inclined operating position there is danger of the oil running to one side of the oil sump and of the lubrication pump drawing in air. When the machine takes up such an inclined position, there is also a chance of the crankshaft immersing in the oil which leads to undesirable losses do to splashing, because the oil is foamed up by the crankshaft and its lubricity decreases rapidly as a result of premature aging. Consequently, frequent oil changes are required. Finally, an oil sump fitted underneath the crankcase also presents a disadvantage inasmuch as the oil has to be drained off and the oil sump has to be dismounted before certain parts of the internal combustion engine can be removed. Ultimately, owing to their position underneath the crankcase the conventional oil sumps can take only a comparatively small quantity of oil which, in turn, necessitates intensive cooling of the oil by means of a cooling system.

SUMMARY OF THE INVENTION

This invention is based upon the objective of providing an internal combustion engine of the type having lubricating and liquid cooling systems and soundproofing cowling with a compact design. One which is not susceptible to breakdowns; one which can be dismantled easily; and one which at the same time has improved lubricating and cooling systems. According to the invention the oil sump problem is solved by using the space which is formed between the soundproofing cowling elements and the outerwalls of the crankcase as an oil reservoir. This space, through the intermediary of an oil return pump, is connected to the interior of the crankcase. The bottom end of the crankcase, is sealed, to hold fluids, by means of a horizontally extending bottom or floor plate. By applying the means described in this invention a new concept is achieved where, for the first time, the entire quantity of lubricant or oil required for the internal combustion engine is no longer accommodated underneath the crankcase, but is now located on the lateral sides of the crankcase. This way of housing the oil assures that in all conceivable operating positions of a vehicle equipped with an internal combustion engine, according to the invention, the aspiration of air by the lubricating pump is prevented. Furthermore, there can be no loss of oil due to splashing caused by the crankshaft movement. As a result of eliminating the conventional oil sump pan underneath the crankcase, excellent ground clearance is obtained. The fitting of the oil reservoir alongside the crankcase renders possible the carrying of a volume of oil greater than that carried in conventional sump pans, which prolongs the periods in between oil changes. Due to the larger surface area of the oil reservoir, an oil cooler is no longer required. This results in a considerable improvement of the internal combustion engine's lubricant cooling system. The lubricant cooling equipment can now be reduced in size or eliminated, or left as is without having to change the size of the original cooling equipment to obtain an improved cooling performance. Furthermore, the available space in the engine compartment is increased by the elimination of the oil cooler. Finally, the elimination of the conventional oil sump underneath the crankcase makes it possible to remove important components of the engine, i.e. crankshaft, main bearing, etc., without having to drain the oil from the oil reservoir. The base plate extending along the bottom of the crankcase considerably improves the stiffness of the crankcase and thus prevents undesirable vibrations. Among other things this represents a considerable reduction of the noise emitted by the internal combustion engine. The oil between the crankcase and the cowling elements certainly contributes to the positive effects described above.

In an appropriate design, according to the invention, a continuously driven oil scavenging pump is mounted on the base plate. Through the intermediary of an intake stack it is connected to the interior of the crankcase, and through the intermediary of a return line with a built-in one-way valve, it is connected to the oil reservoir. In this application the one-way valve assures that the oil flows from the crankcase interior into the oil reservoir, but not vice versa. Furthermore, it is advisable to lead the return line into the bottom end of the oil reservoir and to provide for a suction or lubricant intake tube branching off at an approximate height of one third of the reservoir, whereby said tube leads to a lubrication pump of the lubricating system. By tapping of the suction tube into this section or elevation of the oil reservoir it is assured that even with extreme inclined positions of the vehicle there is an air-free oil intake.

Appropriately, an air space above the oil level in the oil reservoir is in connection with the crankcase interior by way of a venting pipe arranged along the outside of the crankcase. The interior of the crankcase is connected to the intake manifold duct of the internal combustion engine by way of a second venting pipe which is also arranged along the outside of the crankcase. By this arrangement gas vapors accumulating in the air space above the oil level can be led back by way of the crankcase interior to the intake manifold duct, thereby eliminating the danger of hydrocarbon condensation.

This inventive conception produces an internal combustion engine with optimum oil economy. Particularly on an internal combustion engine with water cooling optimizing is required as regards the cooling water economy. To meet these requirements another development according to the invention features a conventional type of cover, located above the oil reservoir, thoroughly encircling the cylinder head and mounted to same. By said cover and a valve cover plate a water collecting chamber is formed. This is an additional means of cooling which assures even outside cooling with best possible effect as regards the cylinder head in particular. Expediently this water collecting chamber is connected to the cooling ducts provided in the cylinder head. Thus the cylinder head is cooled from the inside in the conventional manner, and it is given additional cooling from the outside. Also, the water or coolant media in the collecting chamber acts as a sound bearer and contributes to the reduction of engine noise.

Another feature is the provision of the skirt of the sidewalls being extended below the bottom of the crankcase bearing support to form the sidewalls of the crankcase chamber and to provide a mounting surface for the floor plate which covers and seals the bottom of the crankcase chamber.

Thus there is provided in an internal combustion engine having lubricating and liquid cooling systems including lubricant and coolant medias for use therein, a cylinder block having sidewalls and flanges at the bottoms thereof. A cylinder head is carried on top of the block and includes intake and exhaust manifolds having flanges. There are fuel injection and valve timing mechanisms carried on top of the cylinder head. A soundproofing cowling means is provided for encasing the sidewalls and manifolds and mechanisms which comprises covers mounted to the flanges on the sidewalls and manifolds, the mounted covers form lower and upper chambers demarcated by the manifold flanges. A floor plate extends across the bottom of the engine and is connected to the sidewall flanges. The mounted floor plate defines a crankcase chamber which houses a bearing support. There is further provided a pump which has an intake stack inside the crankcase chamber and an output line which includes a one-way flow check valve therein that is connected to the lower chamber. There is a lubricant inlet pipe that is connected at one end to the lower chamber and is connected at the other end to the lubricating system. A vapor collecting means is provided which includes a first tube that has an upper open end extending above a predetermined level of the lubricant in the lower chamber and a lower open end inside the crankcase chamber that is vertically spaced above the horizontal plane of the inlet pipe connection to the lower chamber. The collecting means further includes a second tube that has a lower open end inside the crankcase chamber at approximately the same elevation as the first tube and has an upper open end which is connected inside the intake manifold. There is further provided a cover cap within the upper chamber which encloses the mechanisms and forms a coolant receiving chamber which is connected to the cooling system.

BRIEF DESCRIPTION OF THE DRAWING

The sole FIGURE illustrates a vertical cross-sectional view of an internal combustion engine according to the invention.

DESCRIPTION OF THE PREFERRED EMBODIMENT

In order that the invention may be readily understood and put into practical effect, reference will now be made to the drawing. There is shown a vertical cross-sectional view of an internal combustion engine having a crankcase 1 installed in a cylinder sleeve 2 in the conventional mode. Above the cylinder sleeve 2 a cylinder head 3 is arranged which has an intake manifold duct 4 and an inlet duct 5 connected thereto. Above the cyinder head 3 but inside a valve cover cap 6, a valve control mechanism 7 and a fuel injecting mechanism 8 are accommodated. The valve control mechanism 7 controls an intake valve 9. Cooling ducts 11 are provided in the cylinder head of the liquid cooled internal combustion engine. On the opposite side of the inlet duct 5, the cylinder head 3 has an exhaust manifold 12 with an exhaust or discharge duct 13. The cylinder head 3, including the valve cover cap 6, is encased by a top cowling 14 fitted with a gasket or seal 41 and is fastened to the laterally extending flanges 43 on the cylinder head 3 forming an upper chamber 44. A coolant collecting chamber 15 is defined by the upper changer 44 by the cover 14, seal 41, the cylinder head 3, the valve cover cap 6 the seal or gasket 40, and the flanges 43 on the cylinder head 3. In a mode not displayed in detail the defined water collecting chamber 15 is connected to the cooling ducts 11 provided in the interior of the cylinder head 3.

A cam shaft 17, which is arranged underneath a cooling water passageway 16 in the crankcase 1, is provided to drive the valve control mechanism 7. A main bearing support 18 with a crankshaft bearing bore 19 is arranged below the crylinder sleeve 2. The drive members, which are of no particular importance as regards the invention (i.e. piston, piston rod, and crankshaft) are not pictured in the drawing. The bottom of the crankcase 1 has outward extending mounting flanges 21 onto which, by the intermediary of a seal 22, a substantially horizontal base plate 23 is affixed. Furthermore, on either side of the crankcase 1 lateral walls 24, 25 serving as cowling elements are mounted to the mounting flanges 21 of said crankcase 1. By the intermediary of upper and lower seals 26 and 42 these lateral walls 24, 25, are fitted at their top and bottom edges to the flanges on the crankcase 1 and cylinder head 3. Together with the crankcase 1 the lateral walls 24, 25, which are laterally spaced from the outerwalls of the crankcase 1, form an oil or lubricant reservoir 27, in which the oil or lubricant required for lubricating the individual components of the internal combustion engine is stored. The drawing shows the entire oil reservoir 27 filled with oil with the exception of a space 28 above the oil level. The large open areas of the outer walls of the cowling plates 24, 25 assist in dissipating the heat from the lubricant to the atmosphere. It is to be noted that the skirt or lateral walls of the cylinder block are extended below the crankshaft bearing support 18 to provide the sidewalls for the crankcase chamber and the flange 21 for mounting the floor plate 23 thereto.

At approximately one third of the height of the oil reservoir 27 there is provided a suction or lubricant intake port 29, onto which an oil suction or lubricant intake pipe 31 is fitted. This oil intake pipe 31 runs to a lubrication pump (not shown) of the lubricating system which is required to lubricate the individual components of the internal combustion engine. Near the bottom end of the side wall reservoir a return or supply line 33 with a one-way valve 32 is inserted into the oil reservoir 27. The supply line 33 is connected to the output of a scavenging (return) pump 34 mounted on the base plate 23. The scavenging pump 34 has an intake stack 36 extending into the interior or chamber 35 of the crankcase 1. By means of this continuously, preferably electrically driven scavenging pump 34, the oil, which is drawn drom the interior 35 of the crankcase by way of the intake stack 36, is fed into the oil reservoir 27 by way of the supply line 33. From here the oil flows via the suction port 29 into the oil suction pipe 31 and to the lubricating pump of the internal combustion engine (Not Shown); from there the oil is delivered to the individual components of the internal combustion engine which require lubrication. Then the oil drops from these lubricated components back into the interior 35 of the crankcase 1, from where it is again drawn in by the intake stack 36 of the scavenging pump. This way a permanent cycle is maintained.

To lead or bleed off any accumulated gas vapors in the space 28 above the oil level in the top of the oil reservoir 27, a venting pipe 37 opens into this space 28, whereby said venting pipe 37 runs along the outside of the crankcase 1 into the crankcase interior 35. Along the opposite outside of the crankcase 1 and starting from the crankcase interior 35 a second venting pipe 38 is arranged, the orifice of which discharges into a port 39 provided in the cylinder head 3, so that the accumulated vapors from the space 28 above the oil level and from the crankcase interior 35 are fed back directly into the intake manifold 4 of the internal combustion engine. Thus these gases cannot escape and, therefore, cannot contribute to a deterioration of environmental conditions. To prevent the vacuum of the intake manifold 4 from passing into the crankcase interior 35 (via the venting pipe 38), the venting pipe 38 is equipped with a throttle (not shown). When dismantling the main engine components, i.e. crankshaft or main bearing, one only needs to detach the base plate 23 from the crankcase 1; thereafter all parts to be dismantled are easily accessible. On principle it is not necessary to drain the oil from the oil reservoir. In view of possible repairs this arrangement presents a considerable simplification. Even with removal of the cylinder head 3 the oil reservoir 27 need not be drained of oil. In this case the only operation required is loosening of the bolts at the top edge of the lateral walls 24, 25.

It is to be understood that the invention is not limited to the embodiment shown, but permits modifications within the scope of the claims. Therefore, instead of oil other media, i.e. fuel or water, could be housed or stored in the reservoir 27.

The embodiments of the invention in which an exclusive property of privilege is claimed are defined as follows:

1. In an internal combustion engine having lubricating and liquid cooling systems including lubricant and coolant medias for use therein, a cylinder block having sidewalls and flanges thereon a cylinder head carried on top of the block and including intake and exhaust manifolds having flanges thereon, fuel injection and valve timing mechanisms carried on top of the cylinder head, soundproofing cowling means for encasing the sidewalls and manifolds and mechanisms comprising covers mounted to the flanges on the sidewalls and manifolds forming lower and upper chambers demarcated by the manifold flanges and a floor plate extending across the bottom of the engine and being connected to the sidewall flanges and defining a crankcase chamber housing a bearing support;

wherein the improvement comprises:

a pump having an intake stack (36) inside the crankcase chamber (35) and a supply line (33) including a one-way flow check valve (32) therein connected to the lower chamber (27);

a lubricant inlet pipe (31) connected at one end to the lower chamber connected at the other end to the lubricating system;

a vapor collecting means including a first tube (37) having an upper open end extending above a predetermined level (28) of the lubricant in the lower chamber and a lower open end inside the crankcase chamber vertically spaced above the horizontal plane of the inlet pipe connection to the lower chamber, and a second tube (38) having a lower open end inside the crankcase chamber at approximately the same elevation as the first tube and an upper open end (39) connected inside the intake manifold (4); and a cover cap (6) within the upper chamber (44) enclosing the mechanisms (7, 8) and forming a coolant receiving chamber connected to the cooling system.

2. In an internal combustion engine, according to claim 1, wherein the inlet pipe is connected to the lower chamber at approximately one-third of the vertical height of either sidewall.

3. In an internal combustion engine, according to claim 1, further including:

a first gasket means (22) between the floor plate (23) and the sidewall flanges (21) for sealing the crankcase chamber from the atmosphere;

a second gasket means (26, 41, 42) between the covers (24, 25, 14) and the flanges (21, 43) on the sidewalls and manifolds for sealing the lower and upper chambers from the atmosphere; and a third gasket means (40) between the cover cap and the flanges on the cylinder head for sealing the mechanisms from the coolant chamber.

4. In an internal combustion engine, according to claim 1, wherein the pump is mounted to the floor plate and the output line including the one-way flow check valve are both located inside the crankcase chamber, and the output line communicates with the lower chamber through an opening in one of the sidewalls.

5. In an internal combustion engine, according to claim 1, wherein the sidewalls of the cylinder block extend below the bearing support (18) forming sidewalls for the crankcase chamber.

6. In an internal combustion engine having lubricating and liquid cooling systems including lubricant and coolant medias for use therein, a cylinder block having sidewalls, a cylinder head carried on top of the block, first soundproofing cowling means for encasing the sidewalls at a spaced-apart distance therefrom and second soundproofing cowling means for encasing the cylinder head at a spaced-apart distance therefrom, the space between the outer surface of the sidewalls and the inner surface of the first cowling means forming a reservoir for the lubricant media and the space between the outer surface of the cyinder head and the inner surface of the second cowling means forming a chamber for the coolant media; the lubricant and coolant medias in their respective spaces providing sound bearers to engine noise.

7. In an internal combustion engine according to claim 6 wherein the first cowling means comprise sheets on each sidewall which are fastened along the edges thereof to the outer surfaces of the sidewalls and including first gasket means between the inner surfaces of the edges and outer surfaces of the sidewalls for sealing the reservoirs from the atmosphere; and the second cowling means comprise a cap on top of the cylinderhead having a depending skirt fastened along the bottom edge thereof to the outer surface of the cylinderhead and including second gasket means between the inner surfaces of the skirt and the outersurface of the cylinderhead for sealing the passageway from the atmosphere.

8. In an internal combustion engine according to claim 6 wherein one of the sidewalls is provided with a lubricant intake port communicating with the lubricating system.

9. In an internal combustion engine according to claim 6 wherein the cylinder head is provided with a coolant passageway which communicates with the chamber.

10. In an internal combustion engine according to claim 7 further including a third cowling means for encasing the bottom of the engine, the third cowling means comprising a plate connected at the edges thereof to the sidewalls and including a third gasket means between the inner surfaces of the edges and the outer surfaces of the sidewalls for sealing the bottom of the engine from the atmosphere.

11. In an internal combustion engine according to claim 10 further including a pump means for pumping lubricant collected in the bottom of the engine into the reservoir.

12. In an internal combustion engine according to claim 11 wherein one of the sidewalls is provided with a lubricant supply port which is connected to the pump means and includes a one-way flow control valve means therein for preventing flow of lubricant from the reservoir to the pump means.

13. In an internal combustion engine according to claim 12 wherein one of the sidewalls is provided with a lubricant intake port which is connected to the lubricating system.

14. In an internal combustion engine according to claim 13 wherein the lubricant intake port is located on the same one sidewall as the lubricant supply port and is located at approximately one-third of the height of said one sidewall.

15. In an internal combustion engine according to claim 10 wherein the sidewalls of the cylinder block extend below a main crankshaft bearing support which is connected to the cylinder block and form inner walls of a crankcase chamber and the plate which is connected to the sidewalls forms a floor for the chamber.

16. In an internal combustion engine according to claim 15 further including a first vent pipe means for communicating an upper air space in the reservoir to an upper air space in the crankcase chamber and a second vent pipe means for communicating the upper air space in the crankcase chamber to an intake manifold duct on the cylinder head.

17. In an internal combustion chamber according to claim 16 further including a pump means for pumping lubricant collected on the floor of the crankcase chamber into the reservoir.

18. In an internal combustion engine according to claim 17 wherein one of the sidewalls is provided with a lubricant supply port which is connected to the pump means and includes a one-way flow control valve means therein for preventing reverse flow from the reservoir to the pump means.

19. In an internal combustion engine according to claim 18 wherein the first vent pipe means communicates to the crankcase chamber through an opening in the one sidewall.

20. In an internal combustion engine according to claim 19 wherein the one sidewall is provided with a lubricant intake port spaced below the vent pipe means opening and in connected to the lubricating system.

21. In an internal combustion engine according to claim 1 wherein the sidewalls of the cylinder block extend below a main crankshaft bearing support which is connected to the cylinder block and form inner walls of a crankcase chamber; and further including a plate extending between the sidewalls and being connected to the bottom therefrom forming a floor for the crankcase chamber.

22. In an internal combustion engine according to claim 21 and further including a supply pump means for pumping lubricant collected on the floor of the crankcase chamber into the reservoir.

23. In an internal combustion engine according to claim 22 wherein one of the sidewalls is provided with a lubricant supply port which is connected to the supply pump means and includes a one-way flow control valve means therein for preventing reverse flow from the reservoir to the supply pump.

24. In an internal combustion engine according to claim 23 wherein the one sidewall is provided with a lubricant intake port spaced above the supply port which is connected to the lubricating system.

25. In an internal combustion engine according to claim 24 wherein the lubricant intake port is located at approximately one-third the height of the one sidewall.

26. In an internal combustion engine according to claim 24 and further including a first vent pipe means for communicating an upper air space in the reservoir to an upper air space in the crankcase chamber; and a second vent pipe means for communicating the upper air space in the crankcase chamber to an intake manifold duct carried on the cylinder head.

27. In an internal combustion chamber according to claim 26 wherein the first vent pipe means communicates to the crankcase chamber through an opening in the one sidewall which is located above the lubricant intake port.

* * * * *